US008899778B2

(12) United States Patent
Yang et al.

(10) Patent No.: US 8,899,778 B2
(45) Date of Patent: Dec. 2, 2014

(54) OPTICAL CAVITY STRUCTURE OF LED LIGHTING APPARATUS

(76) Inventors: Mei-Ling Yang, New Taipei (TW); Chin-Chia Chang, New Taipei (TW)

( * ) Notice: Subject to any disclaimer, the term of this patent is extended or adjusted under 35 U.S.C. 154(b) by 15 days.

(21) Appl. No.: 13/550,622

(22) Filed: Jul. 17, 2012

(65) Prior Publication Data

US 2014/0022781 A1 Jan. 23, 2014

(51) Int. Cl.

| | |
|---|---|
| ***F21V 1/00*** | (2006.01) |
| ***F21V 5/00*** | (2006.01) |
| ***F21V 7/00*** | (2006.01) |

(52) U.S. Cl.

USPC ..... 362/217.09; 362/217.05; 362/217.1; 362/217.11; 362/217.14; 362/217.15; 362/219; 362/235; 362/240; 362/294; 362/307; 362/308; 362/345

(58) Field of Classification Search

CPC ..... F21V 7/00; F21V 7/005; F21V 7/20
USPC ..... 362/307, 240, 219, 308, 345, 294, 235, 362/217.05, 217.09, 217.1–217.17
See application file for complete search history.

(56) References Cited

U.S. PATENT DOCUMENTS

| | | | | |
|---|---|---|---|---|
| 7,267,461 | B2 * | 9/2007 | Kan et al. | 362/373 |
| 7,572,027 | B2 * | 8/2009 | Zampini et al. | 362/225 |
| 7,815,338 | B2 * | 10/2010 | Siemiet et al. | 362/218 |
| 8,235,539 | B2 * | 8/2012 | Thomas et al. | 362/92 |
| 8,235,545 | B2 * | 8/2012 | Zheng et al. | 362/218 |
| 8,360,599 | B2 * | 1/2013 | Ivey et al. | 362/218 |
| 8,403,531 | B2 * | 3/2013 | Negley et al. | 362/249.02 |
| 8,408,742 | B2 * | 4/2013 | Tran | 362/249.02 |
| 2005/0207166 | A1 * | 9/2005 | Kan et al. | 362/373 |
| 2005/0265019 | A1 * | 12/2005 | Sommers et al. | 362/217 |
| 2006/0146531 | A1 * | 7/2006 | Reo et al. | 362/244 |
| 2006/0274529 | A1 * | 12/2006 | Cao | 362/294 |
| 2007/0058377 | A1 * | 3/2007 | Zampini et al. | 362/372 |
| 2007/0228999 | A1 * | 10/2007 | Kit | 315/291 |
| 2008/0037239 | A1 * | 2/2008 | Thomas et al. | 362/92 |
| 2009/0161356 | A1 * | 6/2009 | Negley et al. | 362/231 |
| 2009/0219713 | A1 * | 9/2009 | Siemiet et al. | 362/218 |
| 2009/0290334 | A1 * | 11/2009 | Ivey et al. | 362/219 |
| 2009/0296384 | A1 * | 12/2009 | Van De Ven et al. | 362/231 |
| 2009/0310354 | A1 * | 12/2009 | Zampini et al. | 362/235 |
| 2010/0102729 | A1 * | 4/2010 | Katzir et al. | 315/113 |
| 2010/0103657 | A1 * | 4/2010 | Teng et al. | 362/223 |
| 2010/0128485 | A1 * | 5/2010 | Teng et al. | 362/294 |
| 2010/0172133 | A1 * | 7/2010 | Liu | 362/235 |
| 2010/0177514 | A1 * | 7/2010 | Liu et al. | 362/235 |
| 2010/0220469 | A1 * | 9/2010 | Ivey et al. | 362/218 |
| 2010/0328939 | A1 * | 12/2010 | Chen et al. | 362/235 |
| 2011/0156584 | A1 * | 6/2011 | Kim | 315/32 |
| 2011/0176298 | A1 * | 7/2011 | Meurer et al. | 362/218 |

* cited by examiner

*Primary Examiner* — Thomas A Hollweg
(74) *Attorney, Agent, or Firm* — Leong C. Lei

(57) ABSTRACT

The present invention provides an optical cavity structure of an LED lighting apparatus comprising a base, a light reflector, LED module, and a light cover. The light reflector can be integrally formed with the base or an independent unit. An optical cavity is constructed by the base, light reflector and light cover altogether, and the LED module is attached to the base received within the optical cavity. The light reflector can be symmetrical with inclined angle or as a conical shape provided on two sides opposing to the direction of light from the LED module. The inner surface of the light reflector is a light reflecting surface. The light cover is attached to the light reflector. As a result, the light from the LED is gathered and reflected by the light reflecting surface via the angle and shape of the light reflector to achieve an enhanced luminance range and illumination.

4 Claims, 5 Drawing Sheets

OPTICAL CAVITY STRUCTURE OF LED LIGHTING APPARATUS

TECHNICAL FIELD OF THE INVENTION

The present invention is related to an application and field of lighting, in particular, to a lighting apparatus utilizing the technology capable of enhancing the illumination thereof without increasing the number of light sources and the power consumption required.

DESCRIPTION OF THE PRIOR ART

A conventional lighting apparatus generally comprises a heat sink, a power supply and a LED module; wherein the LED module comprises a plurality of LED chips attached onto a circuit board to generate light upon current and power input to the circuit board thereof. The heat sink, in general, comprises a base and a plurality of fins configured on the base. The LED module is provided on one side of the base opposite to the fins such that as the heat generated by the LED module powered to emit light is conducted to the fins, air flow passing through the fins is able to dissipate the heat therefrom. Such known LED lighting apparatus includes a LED module that is configured to have a certain area size based on to an illumination desired and to have a power supply correspondingly. Therefore, the increased use of the numbers of LED chips and associated power input directly leads to the increase of material costs and power consumption.

SUMMARY OF THE INVENTION

An objective of the present invention is to overcome the drawbacks of known LED lighting apparatus requiring an increased number of LED chips and power input to achieve an enhanced illumination such that the increase in material costs and power consumption associated therewith can be prevented.

The present invention of an LED lighting apparatus is characterized in that an optical cavity is formed among and constructed by a base, a light reflector and a light cover altogether. With the structure of the optical cavity provided, light emitted from the LED module on the base is gathered and further reflected by the light reflecting surface of the light reflector such that the desired luminance range can be achieved to increase the illumination thereof.

The technical features of the lighting apparatus of the present invention comprise a base, a light reflector, at least one LED module with a light cover. The light reflector can be integrally formed with the base or an independent unit. A light cavity is constituted by the light reflector and the light cover and the LED module is provided on the base arranged in an internal of the optical cavity. The light reflector is provided on two inclined and symmetrical sides opposing to the direction of light emitted by the LED module. Alternatively, the light reflector can be of a conical shape provided on the direction of light emitted by the LED module. Furthermore, the inner surface of the light reflector can be configured as a light reflecting surface and the light cover is configured to be attached to the light reflector such that light emitted by the LED module can be gathered and further reflected by the angle and shape of the light reflector selected to achieve the enhanced luminance range and to increase the illumination thereof.

The light reflector of the present invention can be integrally formed with the base or can be configured as an independent unit.

The light reflector of the present invention can be of a conical shape such that the LED lighting apparatus of the present invention can be structured to be of the shape of a light bulb.

The light reflector of the present invention can be a light reflecting part integrally formed with the base with an inclined angle relative to said base such that the LED lighting apparatus is of the shape of a light tube.

The light reflector of the present invention further comprises a first attachment means and the light cover comprises a second attachment means such that the light cover can be attached to the light reflector, or vice versa, by attaching the first and second attachment means with each other.

The light reflecting surface of the light reflector of the present invention can be a flat surface or an arched surface.

The light reflector of the present invention can be of an angle and shape selected for gathering and further reflecting light via the light reflecting surface thereof to achieve the enhanced and desired luminance range.

DETAILED DESCRIPTION OF THE PREFERRED EMBODIMENTS

Figure 1:
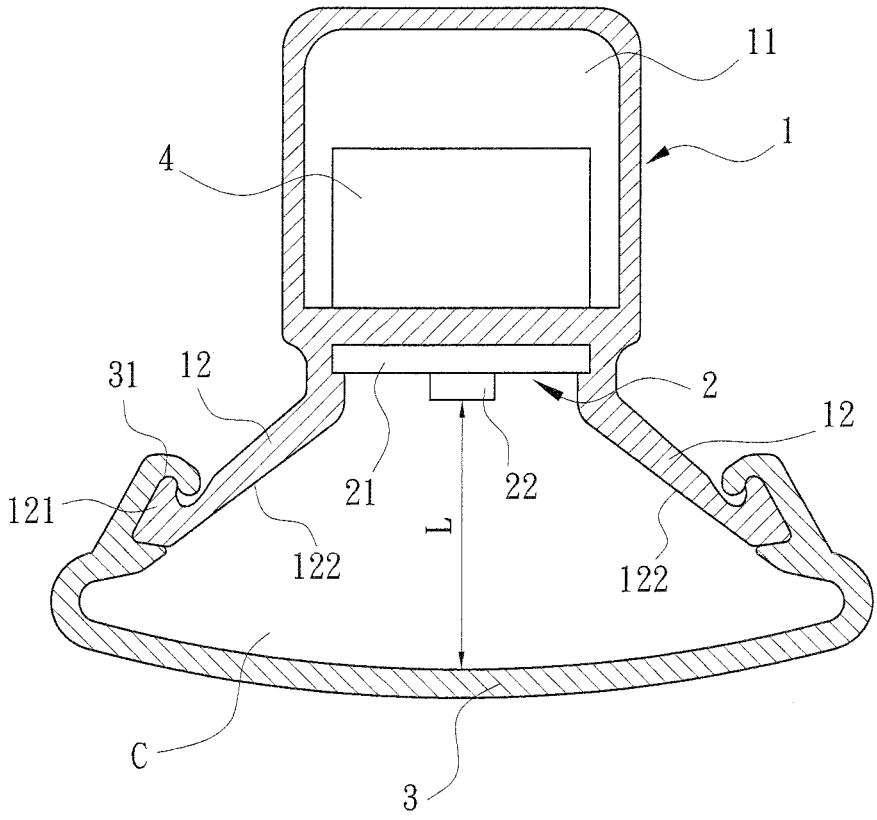
FIG. 1 is a lateral cross-sectional view of a first embodiment of the optical cavity structure of the LED lighting apparatus of the present invention.
Figure 2:
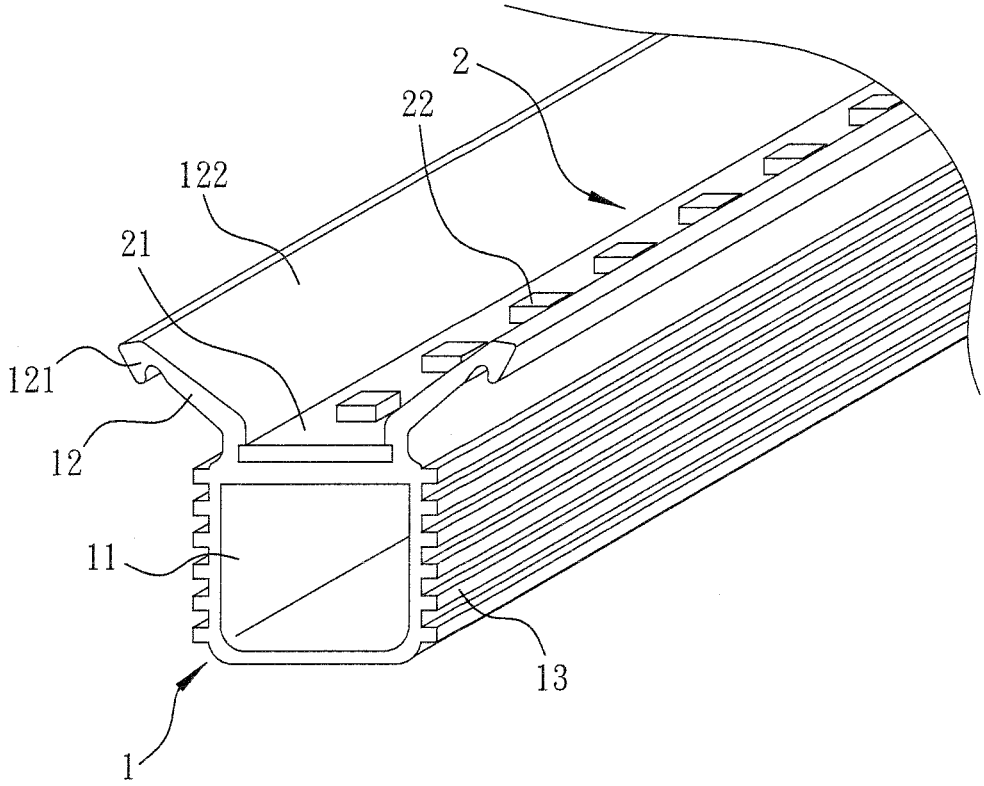
FIG. 2 is a partial perspective view of the first embodiment of the present invention with the structure of the LED module attached to the base.
Figure 3:
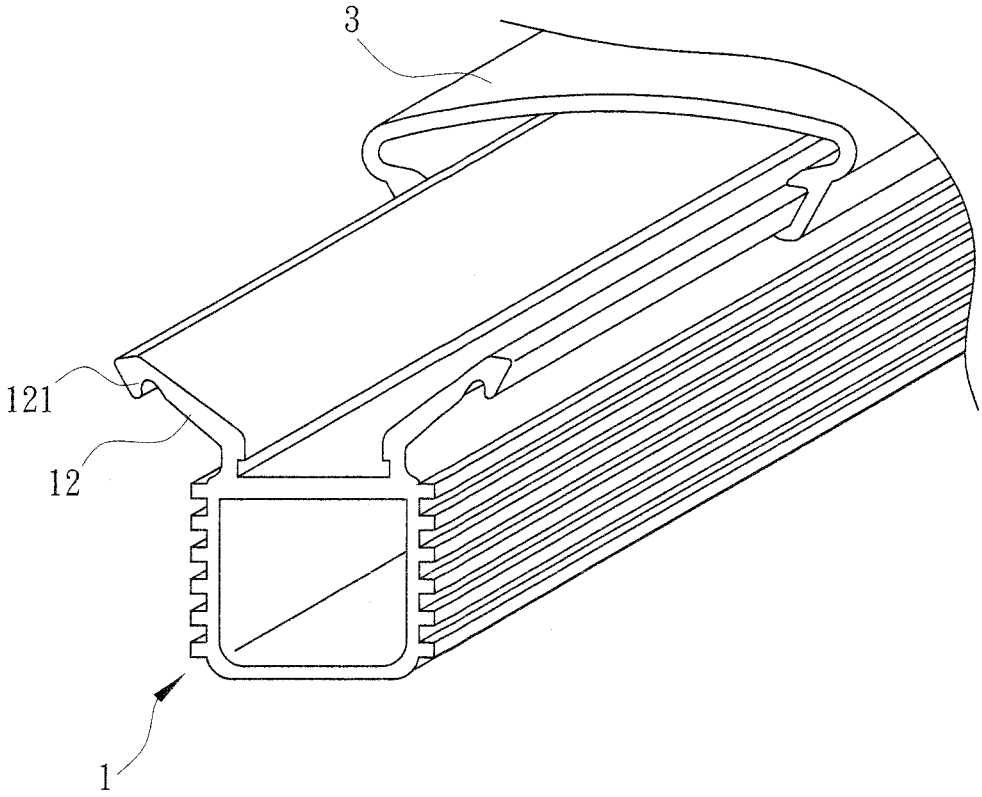
FIG. 3 is a partial perspective view of the first embodiment of the present invention with the structure of the light cover attached to the base.

As shown in FIGS. 1 to 3, a first embodiment of the present invention comprises a base 1, a light reflector 12, a LED module 2 and a light cover 3. The base 1 is preferably made of aluminum material that is of relatively good heat conductivity and heat dissipation and can be produced by injection molding to have an elongated shape. A first end of the base 1 is formed of an internal space 11 to receive a power supply 4 therein; and a second end of the base 1 is provided for the installment or attachment of the LED module 2. In other words, the second end of the base 1 is configured to be in the direction of the emitted light of the LED chips 22 of the LED module 2 while the outer surface of the base 1 is formed with a plurality of fins 13 provided to absorb heat and increase the area of heat dissipation. Preferably, the light reflector 12 is provided on two symmetrical and opposite sides of the second end of the base 1 and integrally formed with the base 1 with an inclined angle therewith; and a light reflecting surface 122 of the light reflector 12 is configured to be facing toward the inner surface thereof. The two light reflectors 12 can too be configured as an independent unit with other securing methods attached to the two symmetrical and opposite sides of the base 1. The light reflecting surface 122 can be a flat surface or an arched surface that is selectable based upon the angle and shape of the light reflector 12 and such that the light is gathered and further reflected by the light reflecting surface 122 to achieve the enhanced and desired luminance range.

The LED module 2 basically comprises a circuit board 21 and a plurality of LED chips 22 attached onto the circuit board 21. The circuit board 21 is provided on the second end of the base 1 and is electrically connected to the power supply 4 received in the internal space 11 thereof. The power supply 4 is electrically connected to an external power source (not shown in the figure) to provide power and current to the circuit board 21 and LED chips 22 thereof upon which LED chips 22 are able to generate light.

The two sides of the light cover 3 can be attached to the two light reflectors 12. Said attachment can be achieved by providing a first attachment means 121 on the two light reflectors 12 respectively and providing a second attachment means 31, capable of attaching to the first attachment means 121, on respective two sides of the light cover 3. The light cover 3 is attached to the light reflectors 12 by attaching the first attachment means 121 to the second attachment means 31 with each other. In the embodiment of the present invention, the first attachment means 121 is a protrusion extended on the outer surface of the light reflector 12, and the second attachment means 31 is a groove provided on the inner surface of the light cover 3. With a slidable cooperation and attachment of said groove and protrusion, the light cover 3 is slidably attached to the light reflector 12. Therefore, a light cavity C is constructed by the light cover 3, the base 1 and the two light reflectors 12 altogether. In addition, the distance between the LED chips 22 and the light cover 3 is defined as or equivalent to the length L of the optical cavity. The length L of the optical cavity depends upon the angle 122 between the two symmetrical light reflecting surfaces 122.

Figure 4A:
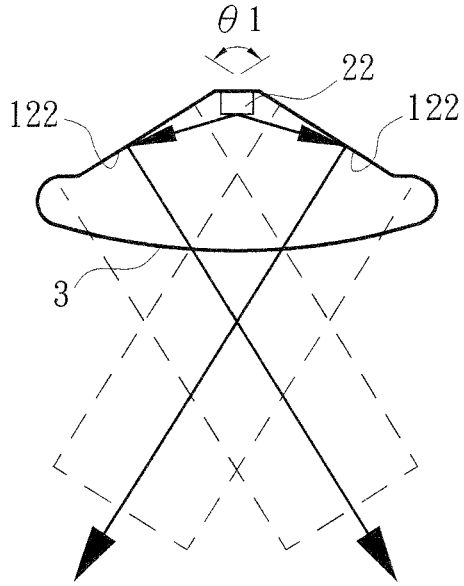
FIG. 4A is an illustration showing the embodiment of the optical cavity of the LED lighting apparatus of the present invention, in which the light reflecting surface is a flat surface with an angle of 120°.
Figure 4B:
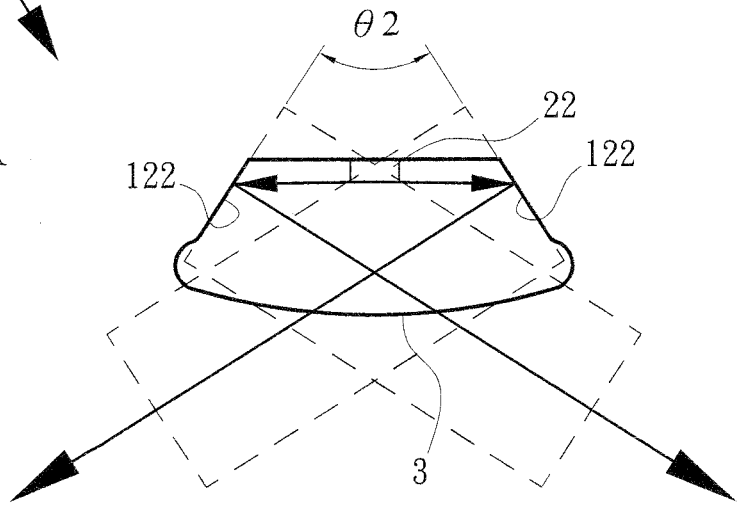
FIG. 4B is an illustration showing the embodiment of the optical cavity of the LED lighting apparatus of the present invention, in which the light reflecting surface is a flat surface with an angle of 60°.

As shown in FIG. 4A, as the angle θ1 between the two light reflectors 12 is equivalent to 120°, the light emitted from the LED chips 22 is projected to the light reflecting surface 122 and from which it is then reflected at an angle of 60° out of the reflector 3. As shown in FIG. 4B, as the angle θ2 between the two light reflectors 12 is equivalent to 60°, the light emitted from the LED chips 22 is projected to the light reflecting surface 122 and from which it is then reflected at an angle of 120° out of the reflector 3. As a result, the luminance range of the lighting apparatus is therefore enhanced or increased.

Figure 4C:
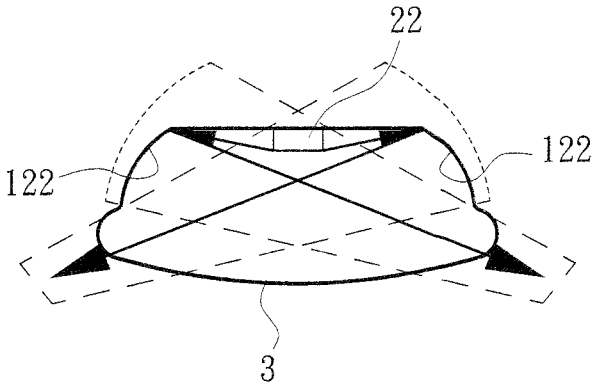
FIG. 4C is an illustration showing the embodiment of the optical cavity of the LED lighting apparatus of the present invention, in which the light reflecting surface is an arched surface.

As shown in FIG. 4C, the light reflecting surfaces 122 of the two light reflectors 12 can be of an arched surface such that as the light emitted from the LED chips 22 is projected to the arched surface, it is then reflect at a suitable reflection angle out of the light cover 3. As a result, the luminance range of the lighting apparatus is therefore enhanced or increased.

Figure 5:
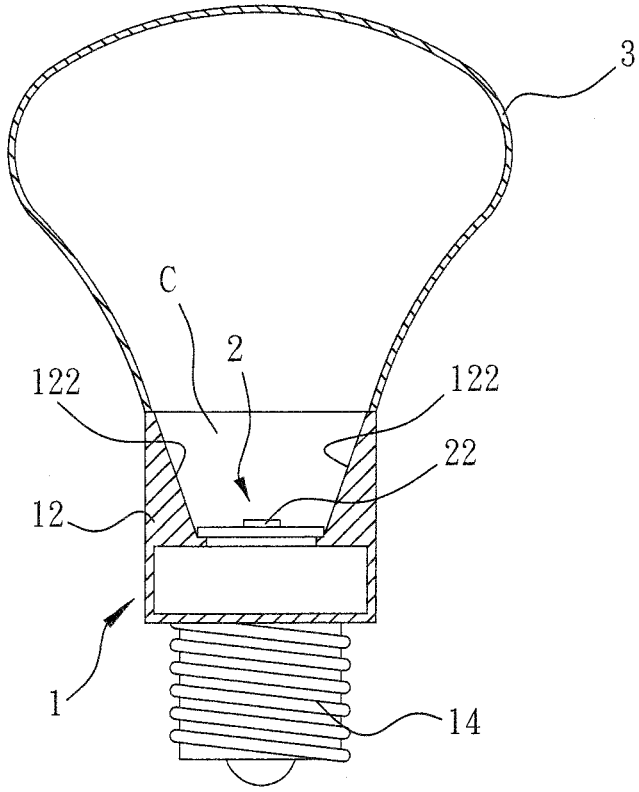
FIG. 5 is a lateral cross-sectional view of a second embodiment of the optical cavity structure of the LED lighting apparatus of the present invention.

The LED lighting apparatus comprising the abovementioned based 1, light reflector 12, LED module 2 and light cover 3 can be configured as a lighting apparatus of a light tube provided for areas demanding a relatively high illumination and as replacement lighting means with greater lighting efficiency for traditional lighting or as energy saving lighting. Nevertheless, it can be understood that the optical cavity structure of the present invention can too be utilized in LED lighting apparatus of a light bulb shape. As shown in FIG. 5, the base 1 can be configured to be of a circular column shape provided to be fastened onto a socket 14. Similarly, base 1 comprises a LED module 2 and a light reflector 12 formed thereon in the direction of emitted light. A light reflecting surface 122 is of a conical shape formed on the inner diameter of the light reflector 12, and the light reflector 12 is attached with a light cover 3 in the shape of a light bulb. Therefore, an optical cavity C is formed among or constructed by the light cover 3, light reflecting surface 122 and the base 1 altogether. The light emitted from the LED chips 22 is projected to the light reflector 122 and from which it is then reflected out of the light cover 3 such that the luminance range thereof is enhanced and the illumination thereof is increased.

What is claimed is:

1. An optical cavity structure of an LED lighting apparatus, comprising: a base that is integrally formed as a unitary, elongate member; a light reflection structure integrally formed with the base; at least one LED module; a power supply; and a light cover; wherein an optical cavity is constructed by said base, said light reflection structure and said light cover altogether; and said at least one LED module is attached onto a second end of the base and received within said optical cavity; said light reflection structure comprises two light reflectors respectively and integrally formed on opposite edges of the second end of the base and each comprising an inside surface that defines a curved light reflecting surface facing an internal space of said optical cavity such that light emitted from said at least one LED module is reflected by said curved light reflecting surface of said light reflector in a converging manner so as to achieve enhanced luminance; said at least one LED module comprises a circuit board and a plurality of LED chips attached onto said circuit board; said circuit board is attached to said second end of said base and is electrically connected to said power supply; a first end of said base opposite to said second end is formed of an internal space; and said power supply is received in said internal space of the first end of the base and electrically connected to an external power source.

2. The optical cavity structure of an LED lighting apparatus according to claim 1, wherein said light reflectors are respectively provided on two symmetrical sides of said base.

3. The optical cavity structure of an LED lighting apparatus according to claim 1, wherein each of said light reflectors comprises a first attachment means and said light cover comprises a second attachment means corresponding to the first attachment means such that said light cover is attached to said light reflector by attaching said first and second attachment means with each other.

4. The optical cavity structure of an LED lighting apparatus according to claim 3, wherein said first attachment means is a protrusion extended on an outer surface of said light reflector, and wherein said second attachment means is a groove formed by recessing said inner surface of said light cover.

* * * * *